US008765044B2

(12) United States Patent
Ness et al.

(10) Patent No.: US 8,765,044 B2
(45) Date of Patent: Jul. 1, 2014

(54) METHOD OF MAKING MASONRY BLOCKS

(75) Inventors: John T. Ness, Stillwater, MN (US); Jeffrey A. Ness, Oak Park Heights, MN (US)

(73) Assignee: Ness Inventions, St. Paul, MN (US)

( * ) Notice: Subject to any disclaimer, the term of this patent is extended or adjusted under 35 U.S.C. 154(b) by 65 days.

(21) Appl. No.: 12/407,568

(22) Filed: Mar. 19, 2009

(65) Prior Publication Data

US 2009/0235606 A1 Sep. 24, 2009

Related U.S. Application Data

(60) Provisional application No. 61/038,144, filed on Mar. 20, 2008.

(51) Int. Cl.

| | |
|---|---|
| ***B28B 3/08*** | (2006.01) |
| ***B28B 17/00*** | (2006.01) |
| ***B28B 17/02*** | (2006.01) |

(52) U.S. Cl.

USPC ..... 264/333

(58) Field of Classification Search

USPC ..... 264/333

See application file for complete search history.

(56) References Cited

U.S. PATENT DOCUMENTS

| | | | | |
|---|---|---|---|---|
| 2,304,660 | A | 12/1940 | Scott | |
| 2,526,198 | A | 10/1950 | Clanton | |
| 2,821,005 | A * | 1/1958 | Davis | 425/330 |
| 3,381,345 | A * | 5/1968 | Williams | 425/385 |
| 4,063,866 | A | 12/1977 | Lurbiecki | |
| 4,869,660 | A | 9/1989 | Ruckstuhl | |
| 6,349,522 | B1 * | 2/2002 | Stevens | 52/749.13 |
| 6,470,762 | B1 | 10/2002 | Burkart | |
| 2002/0125884 | A1 | 9/2002 | Wendt et al. | |
| 2003/0126821 | A1 | 7/2003 | Scherer et al. | |
| 2003/0182011 | A1 | 9/2003 | Scherer | |
| 2004/0170718 | A1 * | 9/2004 | Futamura et al. | 425/149 |
| 2004/0218985 | A1 * | 11/2004 | Klettenberg et al. | 405/284 |
| 2005/0120670 | A1 | 6/2005 | Ness et al. | |
| 2006/0191231 | A1 * | 8/2006 | Ness et al. | 52/596 |
| 2007/0048398 | A1 * | 3/2007 | Tsuji et al. | 425/135 |
| 2007/0088523 | A1 | 4/2007 | Keller et al. | |
| 2007/0193181 | A1 | 8/2007 | Klettenberg et al. | |

FOREIGN PATENT DOCUMENTS

| | | |
|---|---|---|
| JP | 10034626 | 2/1998 |

OTHER PUBLICATIONS

EP Search Report, Apr. 4, 2012, 4 pages.

* cited by examiner

*Primary Examiner* — Christina Johnson
*Assistant Examiner* — Patrick Butler
(74) *Attorney, Agent, or Firm* — Dicke, Billig & Czaja, PLLC

(57) ABSTRACT

A method of making a masonry block employing a mold assembly having a plurality liner plates each having a major surface that together form a mold cavity having an open top and an open bottom, wherein at least one liner plate is moveable between a retracted position and a desired extended position within the mold cavity. The method includes providing a negative of a desired texture on the major surface of the moveable liner plate, moving the moveable liner plate to a retracted position, closing the bottom of the mold cavity by positioning a pallet below the mold assembly, filling the mold cavity with dry cast concrete via the open top, vibrating the mold assembly and dry cast concrete therein, and moving the moveable liner plate to a desired extended position during the vibrating.

8 Claims, 9 Drawing Sheets

METHOD OF MAKING MASONRY BLOCKS

CROSS-REFERENCE TO RELATED APPLICATIONS

This Non-Provisional patent application claims benefit of U.S. Provisional Application No. 61/038,144, filed Mar. 20, 2008, entitled: SYSTEM AND METHOD OF MAKING MASONRY BLOCKS, incorporated herein.

BACKGROUND

Concrete blocks, also referred to as concrete masonry units (CMU's), are typically manufactured by forming them into various shapes as part of an automated process employing a concrete block machine. Such machines typically employ a mold frame assembled so as to form a mold box, within which a mold cavity having a negative of a desired block shape is formed. To form a block, a pallet is moved by a conveyor system onto a pallet table, which is then moved upward until the pallet contacts and forms a bottom of the mold cavity.

The mold cavity is then filled with concrete and a head shoe assembly is positioned to form a top of the mold cavity. The head shoe assembly then compresses the concrete (typically via hydraulic or mechanical means) to a desired psi rating (pounds-per-square-inch) while simultaneously vibrating the mold cavity along with the vibrating table. As a result of the compression and vibration, the concrete reaches a level of "hardness" which enables the resulting finished block to be immediately removed from the mold cavity. To remove the finished block, the mold frame and mold cavity remain stationary while the shoe assembly, pallet, and pallet table move downward and force the finished block from the mold cavity. The conveyor system then moves the pallet bearing the finished block away and a clean pallet takes its place. This process is repeated for each block.

For many types of CMUs (e.g. pavers, patio blocks, lightweight blocks, cinder blocks, etc.), retaining wall blocks and architectural units in particular, it is desirable for at least one surface of the block to have a desired texture, such as a stone-like texture, for instance. When arranged to form a structure with the textured surface visible, the structure will have the appearance of being constructed from natural stone.

One technique for creating a desired texture on a block surface is to provide a negative of a desired texture or pattern on a moveable side wall of the mold cavity. During the manufacturing process, the side wall is moved to an extended position to form the mold cavity. As described above, the mold cavity is then filled with concrete and compressed/vibrated. The side wall is then moved to a retracted position and the finished block, as described above, is forced from the mold cavity and onto the pallet by the head shoe assembly. The finished block, including a surface having the desired texture, is then transported on the pallet by the conveyor for curing.

While such a technique is effective at forming a textured surface, air pockets trapped between the textured surface of the moveable side wall and concrete fill are forced out during the compression/vibration process, causing the concrete to settle proximate to the textured surface and resulting in the finished block having a height along the textured surface (e.g. front face of block) which is shorter than that along an opposite surface (e.g. rear face of block). Consequently, unless compensated for in some fashion, a structure (e.g. a retaining wall) will tend to have an undesirable lean in a direction toward the textured surface.

SUMMARY

One embodiment provides a method of making a masonry block employing a mold assembly having a plurality liner plates each having a major surface that together form a mold cavity having an open top and an open bottom, wherein at least one liner plate is moveable between a retracted position and a desired extended position within the mold cavity. The method includes providing a negative of a desired texture on the major surface of the moveable liner plate, moving the moveable liner plate to a retracted position, closing the bottom of the mold cavity by positioning a pallet below the mold assembly, filling the mold cavity with dry cast concrete via the open top, vibrating the mold assembly and dry cast concrete therein, and moving the moveable liner plate to a desired extended position during the vibrating.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
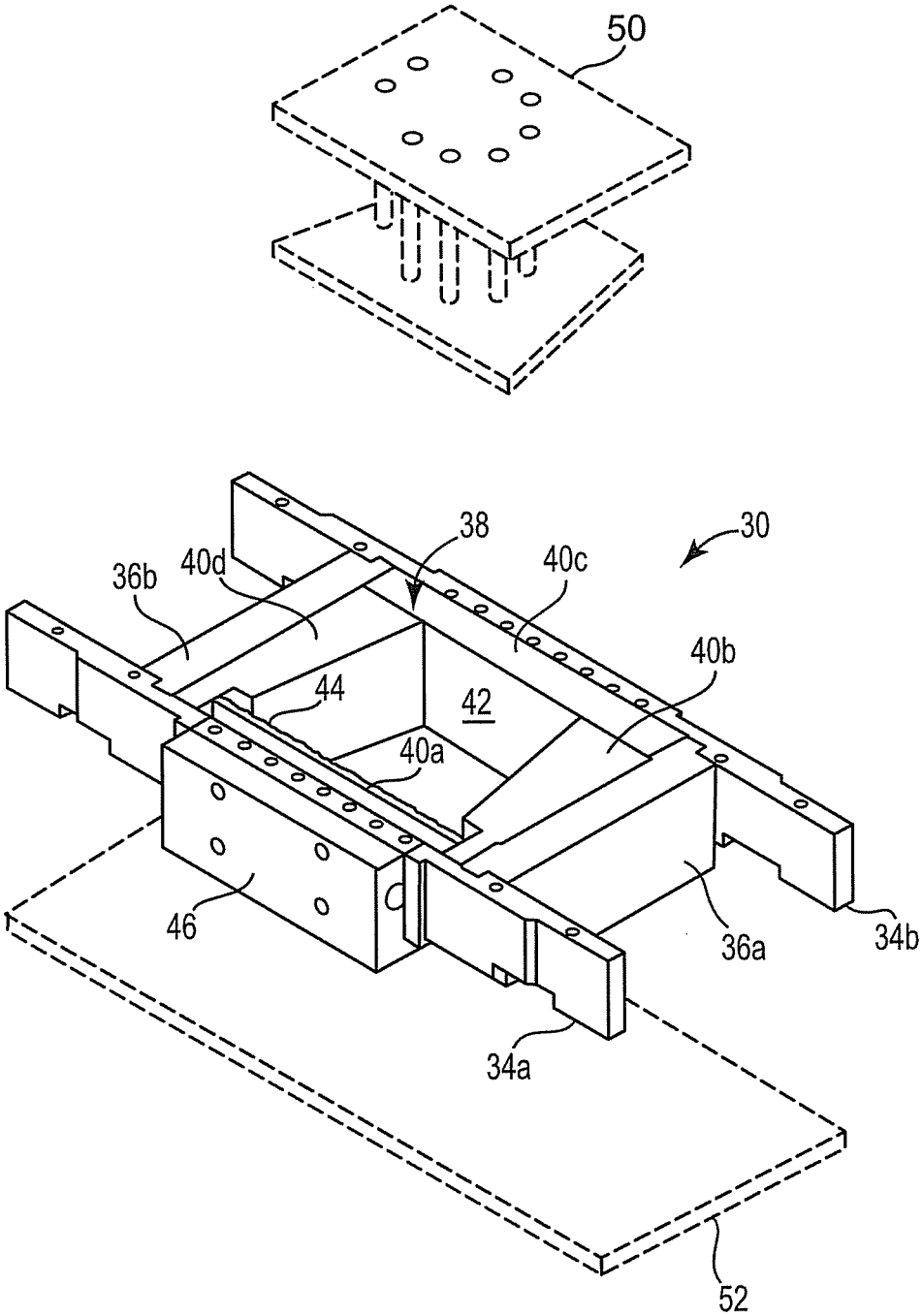
FIG. 1 is a perspective view illustrating generally one embodiment of a mold assembly according to embodiments of the present invention.

FIG. 1 is a perspective view illustrating generally one embodiment of a mold assembly 30 having at least one moveable liner plate and which is suitable for forming a masonry block having at least one textured surface, or face, according to embodiments of the present invention. Mold assembly 30 is configured and adapted for use in an automated concrete block machine, such as those machines manufactured by Besser Company (Alpena, Mich.) and Columbia Machine, Inc. (Vancouver, Wash.), for example. Mold assembly 30 includes a mold frame having side-members 34*a* and 34*b* and cross-member 36*a* and 36*b* that are coupled to one another to form a mold box 38. A plurality of liner plates 40, illustrated as liner plates 40*a*, 40*b*, 40*c*, and 40*d* are positioned within mold box 38 to form a mold cavity 42, wherein the plurality of liner plates are positioned to form a desired shape for a masonry block to be formed therein.

In one embodiment, as illustrated, liner plate 40*a* is moveable between a retracted and a desired extended position within mold box 38, while liner plates 40*b*, 40*c*, and 40*d* are stationary. In other embodiments, up to all liner plates of the plurality of liner plates 40 are moveable between a corresponding extended and retracted position within mold box 38 to form mold cavity 42. In one embodiment, as illustrated, moveable liner plate 42*a* includes a liner face 44 having a negative of a desired texture, pattern, or other design to be formed on a face of a masonry block to be molded within mold cavity 42 by mold assembly 30.

Mold assembly 30 further includes a drive assembly 46 which is selectively coupled to and configured to drive moveable liner plate 40*a* and thus, moveable liner face 44, between the retracted and desired extended positions within mold cavity 42. In one embodiment, as will be described in greater detail below by FIGS. 2 and 3, drive assembly 46 includes a position sensor configured to provide an indication of a position of moveable liner plate 40*a* within mold cavity 42, wherein drive assembly 46 moves moveable liner plate 40*a* to a desired extended position within mold cavity 42 based on the position indication from the position sensor.

Mold assembly 30 is configured to selectively couple to a concrete block machine. For ease of illustration, the concrete block machine is not shown in FIG. 1. In one embodiment, mold assembly 30 is mounted to the concrete block machine by bolting side members 34*a* and 34*b* to the concrete block machine. In one embodiment, mold assembly 30 further includes a head shoe assembly 50 having dimensions similar to those of mold cavity 46 and which is also selectively coupled to the concrete block machine. During formation of a masonry block, head shoe assembly 50 and a pallet 52 respectively form a top and a bottom of mold cavity 42.

Figure 2:
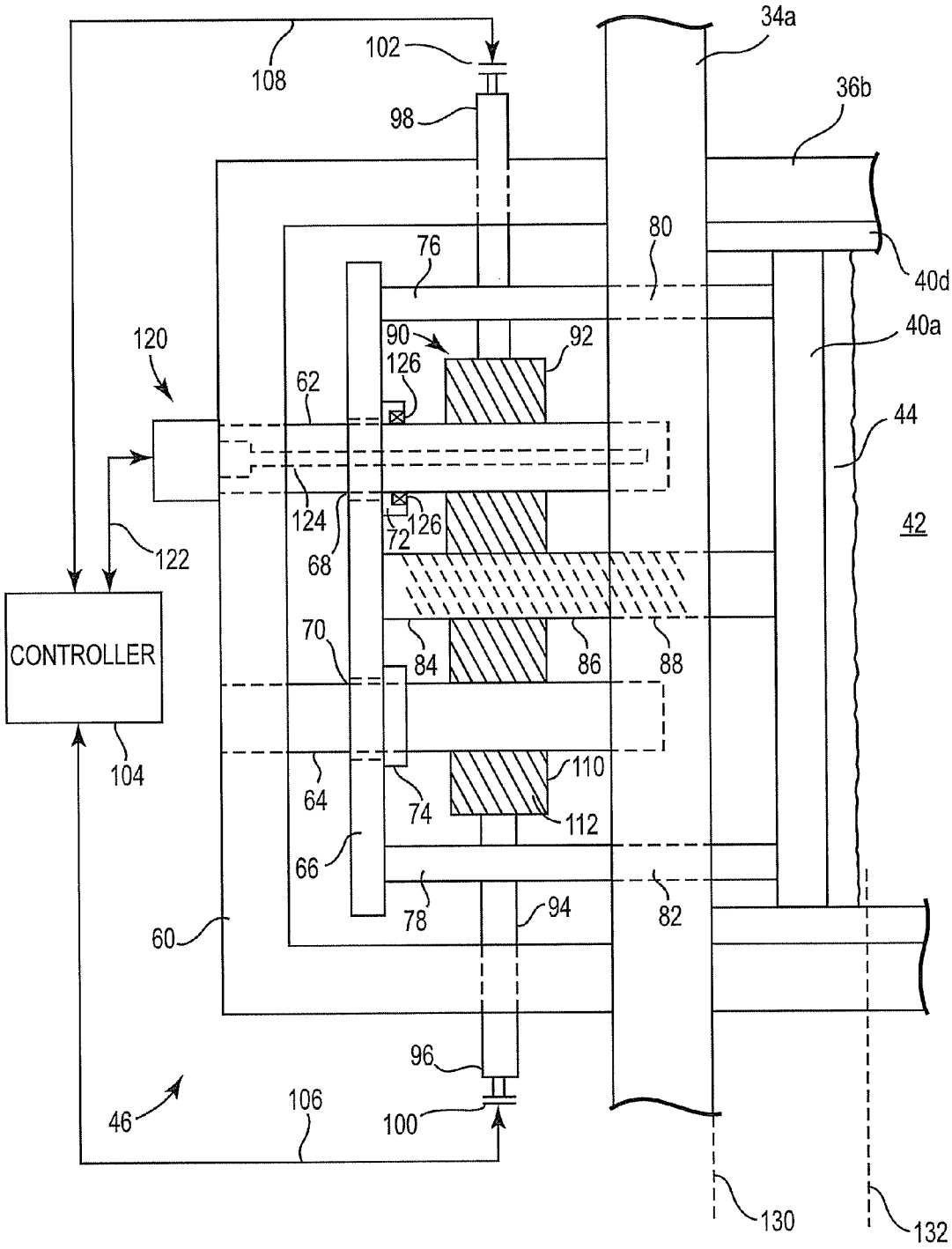
FIG. 2 is a top view illustrating generally one embodiment of a drive assembly according to embodiments of the present invention.

FIG. 2 is a top view of portions of mold assembly 30 of FIG. 1, and illustrates generally a block and schematic diagram of one embodiment of drive assembly 46 according to the present invention. Drive assembly 46 is substantially enclosed within a housing 60 which is coupled to side member 34*a* by support shafts 62 and 64. In one embodiment, support shafts 62 and 64 extend through corresponding openings in housing 60 and thread into corresponding threaded openings in side member 34*a*. In one embodiment, support shafts 62 and 64 are cylindrical in shape. In one embodiment, support shafts 62 and 64 comprise stainless steel or other non-magnetic materials.

Drive assembly 46 further includes a master bar 66 having openings 68 and 70 through which support shafts 62 and 64 extend. In one embodiment, master bar 66 includes bushings 72 and 74 respectively mounted within openings 68 and 70. In one embodiment, bushings 72 and 74 comprise brass or other non-magnetic materials. Guide posts 76 and 78 are coupled between master bar 66 and moveable liner plate 40*a* and extend through corresponding openings 80 and 82 in side member 34*a*. A first drive element 84 having a plurality of angled channels 86 (illustrated by dashed lines) is coupled between master bar 66 and moveable liner plate 40*a* and extends through a corresponding opening 88 in side member 34*a*.

Drive assembly 46 further includes an actuator assembly 90. In one embodiment, as illustrated, actuator assembly 90 comprises a double-rod end hydraulic piston assembly including a dual-acting cylinder 92 and a hollow piston rod assembly 94 having a first hollow rod-end 96 and a second hollow rod-end 98. First and second hollow rod-ends 96 and 98 are stationary and extend through removable housing 60. Hydraulic fittings 100 and 102 respectively connect first and second hollow rod-ends 96 and 98 to a controller 104 via hydraulic fluid lines 106 and 108.

Figure 3:
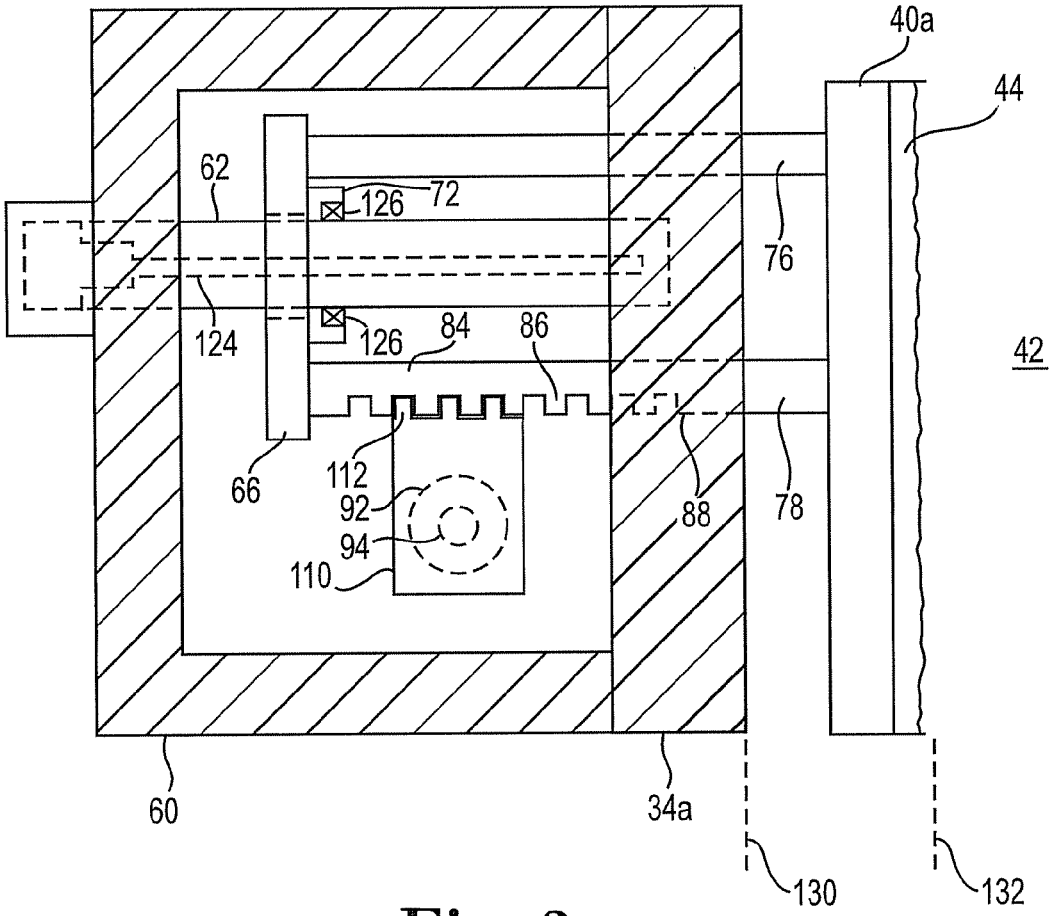
FIG. 3 is a sectional view of the drive assembly of FIG. 2.

A second drive element 110 having a plurality of angled channels 112 configured to slideably interlock with the plurality of angled channels 86 of first drive element 84 is coupled to dual-acting cylinder 92. In one embodiment, the plurality of angled channels 112 are formed as part of a body of dual-acting cylinder 92 such that second drive element 110 is contiguous with the body of dual-acting cylinder 92. In one embodiment, as illustrated by FIG. 3, which is a cross-sectional view illustrating portions of drive assembly 46 of FIG. 2, second drive element 110 is separate from and coupled to dual-acting cylinder 92. In one embodiment, as illustrated by FIG. 3, dual-acting cylinder 92 is positioned internal to second drive element 110.

A drive assembly similar to drive assembly 46, including an actuator assembly employing gear elements and interlocking angled channels, similar to actuator assembly 90 and first and second drive elements 84 and 110, is described by U.S. patent application Ser. No. 10/629,460 assigned to the same assignee as the present invention (now U.S. Pat. No. 7,156,645), and which is incorporated herein by reference.

In one embodiment, drive assembly 46 further includes a magnetic sensor assembly 120 configured to provide a position signal 122 indicative of a position of moveable liner plate 40*a* to controller 104. In one embodiment, magnetic sensor assembly comprises a linear position sensor. Magnetic sensor assembly 120 includes a stationary magnetic sensor probe 124 which is mounted within a bored shaft internal to support shaft 62, and a permanent magnet 126 which is mounted to bushing 72 and which, as will be described below, is free to slide along support shaft 62 with master bar 66 when driven by double-rod end hydraulic piston assembly 90. The position of permanent magnet 126 relative to magnetic sensor probe 124 and, thus, a position of moveable liner plate 40*a* relative to mold cavity 42, is indicated by position signal 122. In one embodiment, magnetic sensor assembly 120 comprises a Model No. TMI0400002111102 linear position sensor as manufactured by Novotechnik, Southborough, Mass.

In operation, with reference to FIGS. 1-3 above, drive assembly 46 is configured to move moveable liner plate 40*a* and corresponding liner face 44 between a retracted position 130 and a desired extended position 132, indicated by dashed lines on FIGS. 2 and 3. To move liner plate 40*a* toward desired extended position 132, controller 104 transmits hydraulic fluid into dual-acting cylinder 92 via hydraulic line 106 and first hollow rod-end 96 causing dual-acting cylinder 92 and angled channels 112 of second drive element 110 to move along hollow piston rod 94 toward second hollow rod-end 98, and causing hydraulic fluid to expelled from second hollow rod-end 98 via hydraulic line 108. As dual-acting cylinder 92 moves toward second hollow rod-end 98, the plurality of angled channels 112 of second drive element 110 interact with the plurality of angled channels 86 and drive first drive element 84 and moveable liner plate 40*a* toward desired extended position 132.

Because first drive element 84 is coupled to master bar 66, driving first drive element 84 toward desired extended position 132 also causes master bar 66 and guide posts 76 and 78 to move toward desired extended position 132. As master bar 66 moves toward mold cavity 42, permanent magnet 126 slides along support shaft 62 and, thus, along stationary magnetic sensor probe 124. As permanent magnet 126 moves along a length of stationary magnetic probe 124, magnetic sensor assembly 120 provides position signal 122 indicative of the position of permanent magnet along support shaft 62 and, thus, indicative of the position of moveable liner plate 40*a* relative to mold cavity 42. When position signal 122 indicates that moveable liner plate 40*a* has reached desired extended position 132, controller 104 stops transmitting hydraulic fluid to dual-acting cylinder 92 and maintains moveable liner plate 40*a* at desired extended position 132. It is noted that extended position 132 may vary for various type of masonry blocks formed by mold assembly 30.

Conversely, to move liner plate 40*a* away from mold cavity 42 toward retracted position 130, controller 104 transmits hydraulic fluid into dual-acting cylinder 92 via hydraulic line 108 and second hollow rod-end 9, causing dual-acting cylinder 92 and angled channels 112 of second drive element 110 to move along hollow piston rod 94 toward first hollow rod-end 96, and causing hydraulic fluid to be expelled from first hollow rod-end 96 via hydraulic line 106. As dual-acting cylinder 92 moves toward first hollow-rod end 96, the plurality of angled channels 112 of second drive element 110 interact with the plurality of angled channels 86 of drive element 84 and drive moveable liner plate 40*a* away from extended position 132 toward retracted position 130. In a fashion similar to that described above, when position signal 122 indicates that moveable liner plate 40*a* has reached retracted position 130, controller 104 stops transmitting hydraulic fluid to dual-acting cylinder 92 and maintains moveable liner plate 40*a* at retracted position 130.

Figure 4A:
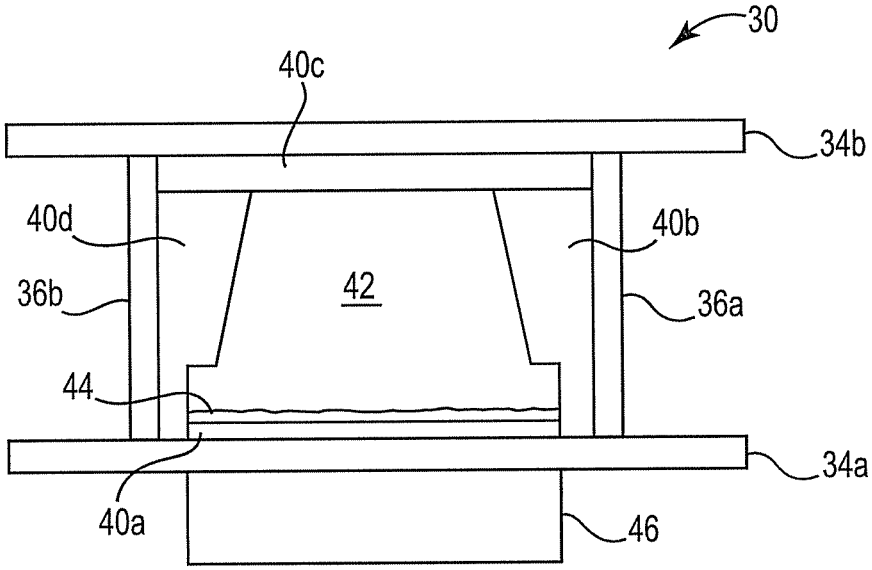
FIG. 4A illustrates a masonry block formation process according to embodiments of the present invention.

FIGS. 4A through 4D are simplified illustrations of mold assembly 30 of FIGS. 1-3 and illustrate the formation of a masonry block employing a block formation process according to embodiments of the present invention. FIG. 4A is a top view of mold assembly 30 showing moveable liner plate 40*a* in retracted position 130. In one embodiment, while moveable liner plate 40*a* is in retracted position 130, mold cavity 42 is filled with concrete. In one embodiment, moveable liner plate 40*a* is in a partially extended position when mold cavity 42 is filled with concrete.

Figure 4B:
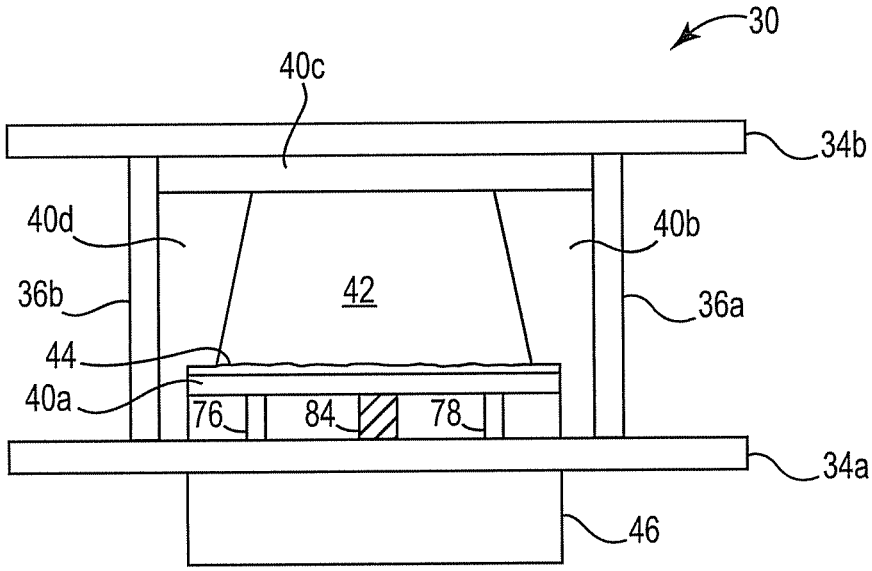
FIG. 4B illustrates a masonry block formation process according to embodiments of the present invention.

In one embodiment, after mold cavity 42 is filled with concrete, head shoe assembly 50 is moved downward to mold cavity 42. The concrete block machine in which mold assembly 30 is installed (not shown) then begins to vibrate mold assembly 30 and head shoe assembly 50 begins to compress the concrete within mold cavity 42 as drive assembly 46 drives moveable liner plate 40*a* toward extended position 132. When position signal 122 indicates that moveable liner plate 40*a* has reached desired extend position 132, drive assembly 46 stops moving liner plate 40*a* and maintains it at extended position 132, and the vibration and compression continues as necessary. FIG. 4B illustrates moveable liner plate 40*a* and textured liner face 44 after reaching extended position 132.

Figure 4C:
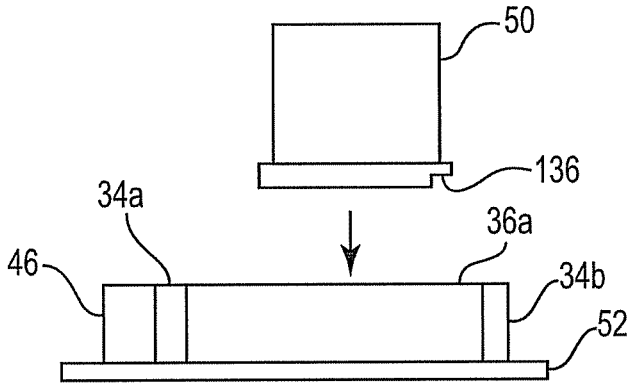
FIG. 4C illustrates a masonry block formation process according to embodiments of the present invention.
Figure 4D:
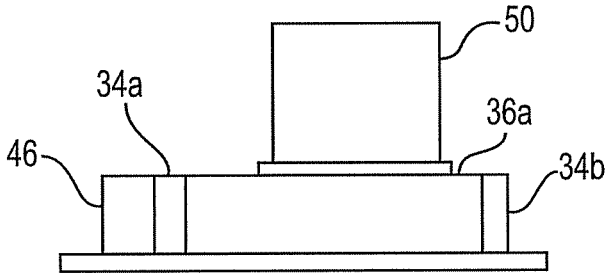
FIG. 4D illustrates a masonry block formation process according to embodiments of the present invention.

FIGS. 4C and 4D are side views of mold assembly 30 of FIGS. 4A and 4B and respectively illustrate head shoe assembly 50 in a raised position and in a lowered position relative to mold cavity 42. In one embodiment, head shoe assembly 50 includes a notch 136 which, as will be described below, forms a set-back flange in a masonry block formed by mold assembly 30. In one embodiment, as described above, head shoe assembly 50 is lowered onto mold cavity 42 prior to movement of liner plate 40*a* by drive assembly 46 and vibration of mold assembly 30. In another embodiment, head shoe assembly is lowered onto mold cavity 42 and begins to compress the concrete therein after drive assembly 46 begins to drive moveable liner plate 40*a* toward extended position 132 and after the concrete block machine begins to vibrate mold assembly 30.

By moving moveable liner plate 40*a* to extended position 42 after mold cavity 42 has been filled, and by compressing and vibrating the concrete within mold cavity 42 as moveable liner plate 40*a* is being moved toward extended position 132, air pockets trapped between the concrete within mold cavity 42 and textured liner face 44 are substantially removed during the block formation process.

Figure 5A:
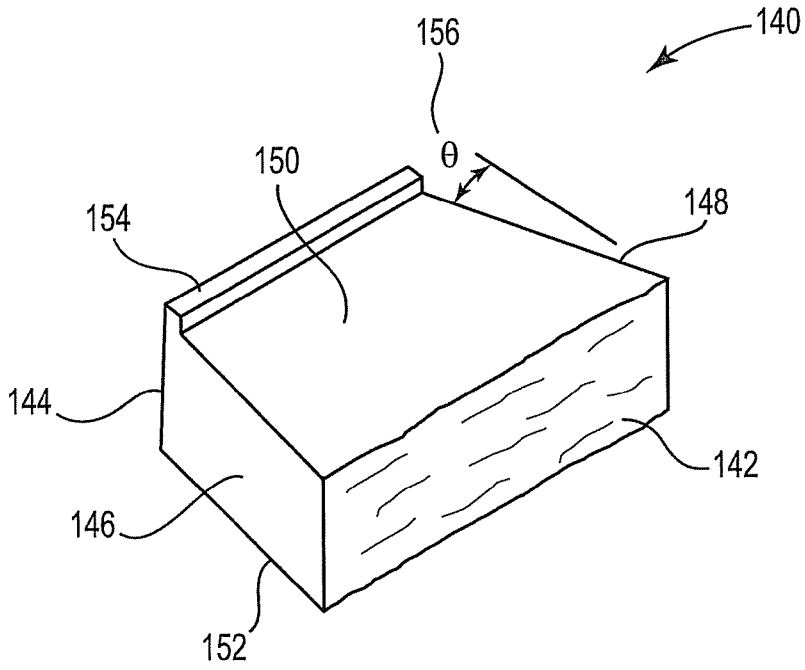
FIG. 5 is a masonry block formed by a masonry block formation process according to embodiments of the present invention.
Figure 5B:
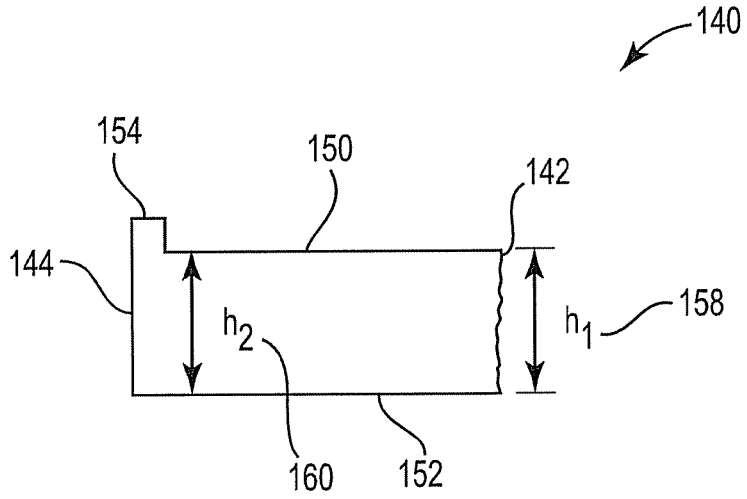

FIGS. 5A and 5B illustrate an example of a masonry block 140 formed by mold assembly 30 of FIGS. 1-3 and the process described above by FIGS. 4A through 4D. Masonry block 140 is commonly referred to as a retaining wall block. Retaining wall block 140 includes a front face 142 having a three-dimensional pattern formed by textured liner face 44 of moveable liner plate 40*a*, a rear face 144 formed by stationary liner plate 40*c*, and opposing side faces 146 and 148 respectively formed by stationary liner plates 40*b* and 40*d*. A bottom face 150 is formed by head shoe assembly 50 and an opposing top face 152 is formed by pallet 52. In one embodiment, as illustrated, bottom face 150 includes a set-back flange 154 extending from bottom face 150 along an edge formed with rear face 144, wherein set-back flange 154 is formed through cooperation between notch 136 of head shoe assembly 50 and stationary liner plate 40*c*. In one embodiment, as illustrated, opposing side face 146 and 148 are angled inwardly from front face 142 toward rear face 144 at an angle (θ) 156. Set-back flange 154 is formed through cooperation between stationary liner plate 40*c* and notch With reference to FIG. 5B, which is a side view of retaining wall block 140, by compressing and vibrating the concrete within mold cavity 42 as moveable liner plate 40*a* is being moved toward extended position 132, substantially all air trapped between the concrete within mold cavity 42 and textured liner face 44 is removed during the block formation process such that a height h1 158 of front face 142 is substantially the same as a height h2 160 proximate to rear face 144 and set-back flange 154.

Figure 6:
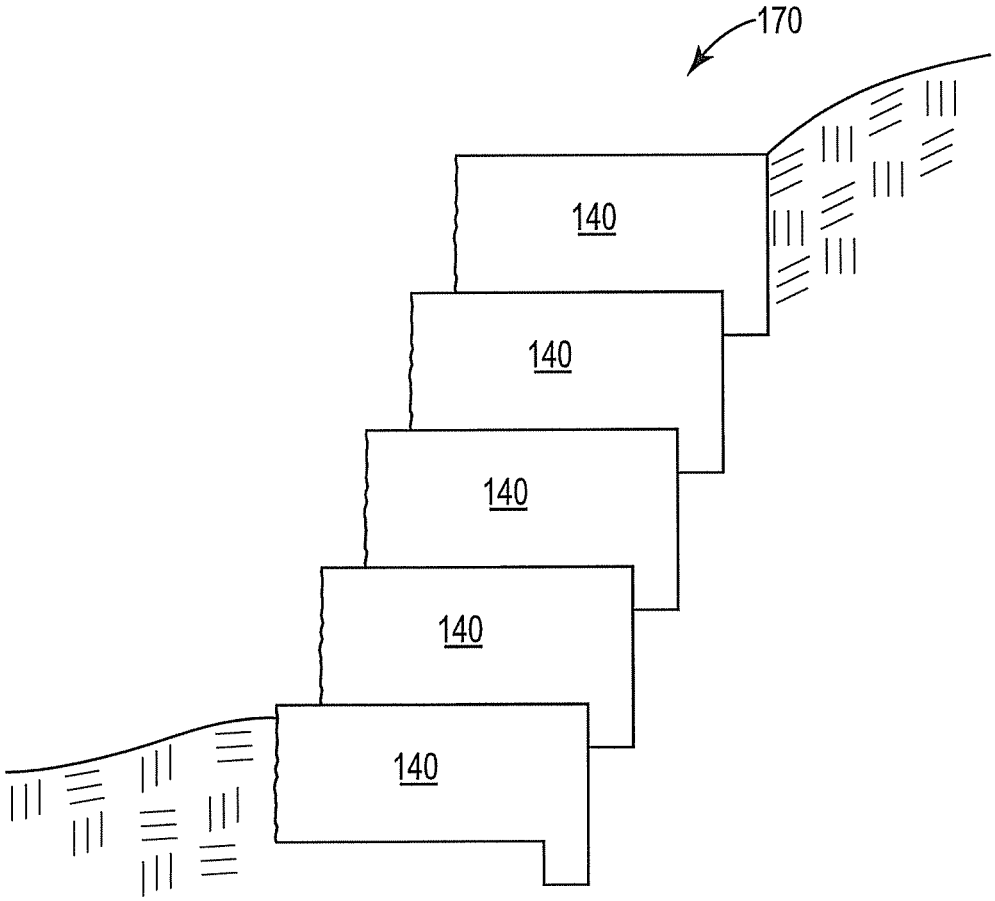
FIG. 6 is an example structure formed by the masonry block of FIG. 5.

Retaining wall blocks, such as retaining wall block 140, are generally stacked in courses to form a structure, such as a retaining wall or planting bed, for example. Set-back flange 154 is adapted to abut against a rear face of a similar block in a course of blocks below retaining wall block 140 so as to position front face 142 at a desire set-back distance from the front face of the blocks in the course below. FIG. 6 is a cross-sectional view of an example soil retention wall 170 constructed using masonry blocks 140 as illustrated by FIGS. 5A and 5B. Because height h1 158 is substantially equal to height h2 160, each successive course of blocks of soil retention wall 170 is substantially horizontal.

Figure 7A:
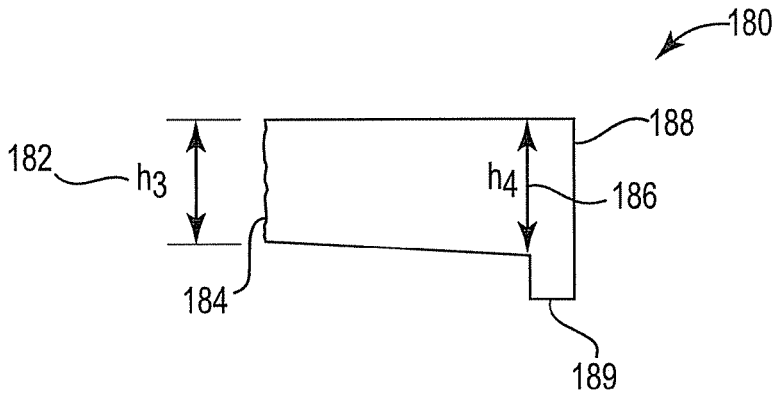
Fig. 7A PRIOR ART
FIG. 7A is masonry block formed by conventional methods.
Figure 7B:
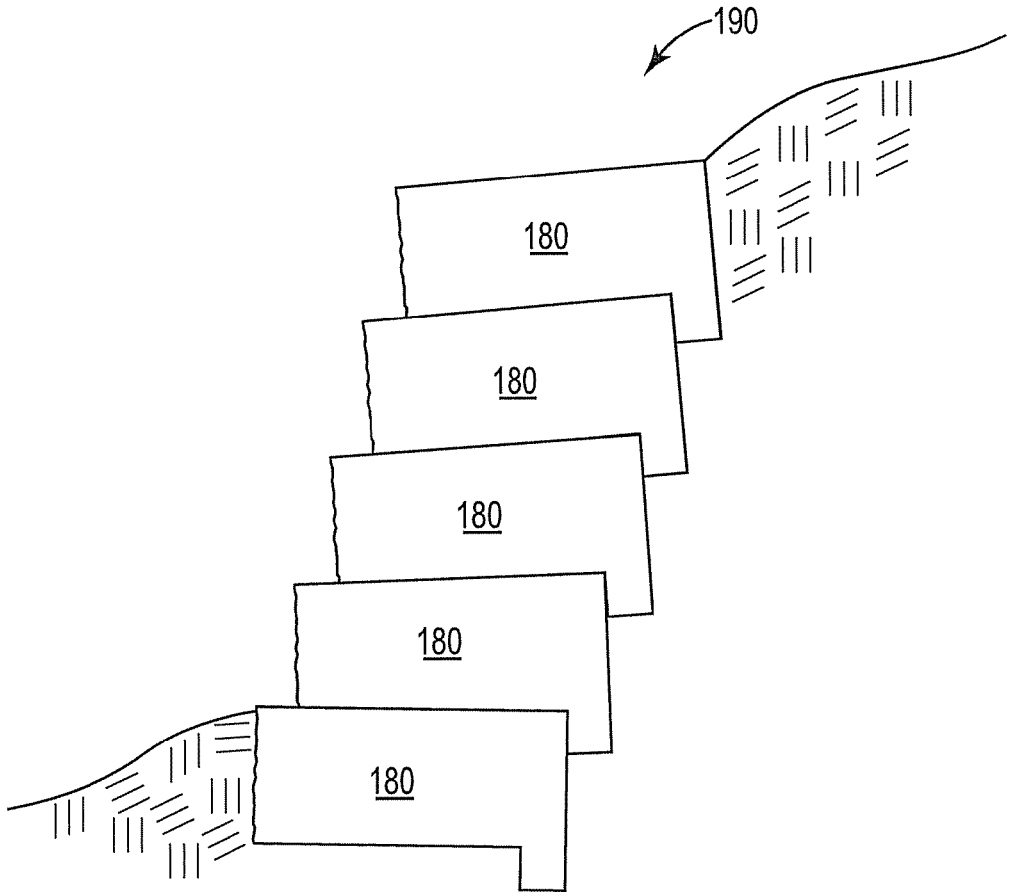
Fig. 7B PRIOR ART
FIG. 7B is an example structure formed by the masonry block of FIG. 7A.

FIG. 7A is a side view illustrating a masonry block 180, which is similar to masonry block 140, but5 formed by a concrete block machine employing a conventional formation method of filling, compacting, and vibrating the concrete fill after a moveable liner plate having a desired texture is positioned at an extended position. As illustrated, because air trapped between the textured surface of the moveable liner plate and the concrete fill is removed after the moveable liner plate is in the extended position, the concrete fill is compressed and settles such that a height h3 182 of a textured front face 184 is less than a height h4 186 proximate to a rear face 188 and a set-back flange 189. As such, when stacked to form a soil retention wall 190, as illustrated by FIG. 7B, each course of blocks is tilted downward from horizontal such that soil retention wall 190 leans further downward from horizontal with each successive course of blocks causing soil retention wall 190 to have a forward lean. Such a forward lean is undesirable and may cause soil retention wall 190, or other structure formed using masonry blocks 180, to become unstable.

Figure 8:
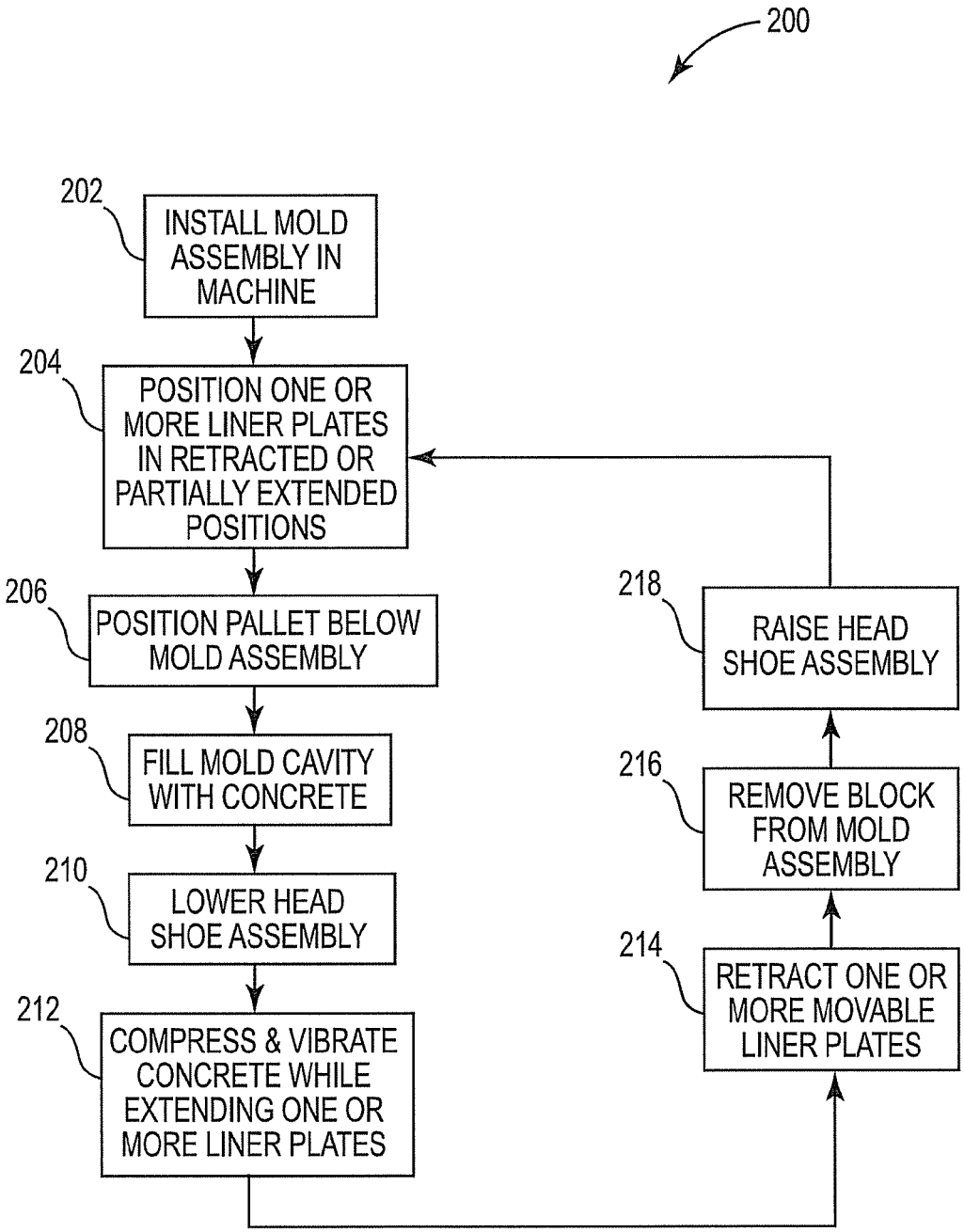
FIG. 8 is a flow diagram illustrating one embodiment of a masonry block formation process according to embodiments of the present invention.

FIG. 8 is a flow diagram illustrating one embodiment of a process 200 for forming masonry blocks according to the present invention. Process 200 begins at 202, where mold assembly 30 is mounted to a concrete block machine, such as by bolting side members 34*a* and 34*b* to the concrete block machine. In one embodiment, mold assembly 30 further includes head shoe assembly 50, which is also bolted to the concrete block machine.

At 204, one or more liner plates, such as moveable liner plate 40*a*, are positioned at a beginning or starting position. In one embodiment, the starting position comprises the corresponding retracted position of each moveable liner plate. In one embodiment, the starting position comprises a partially extended position. Depending on a particular implementation and a particular type of masonry block to be formed, mold assembly 30 may include one or more moveable liner plates. At 206, the concrete block machine positions pallet 52 so as to form a bottom for mold cavity 42.

At 208, the concrete block machine fills mold cavity 42 with a desired concrete mixture. At 210, after mold cavity 42 has been filled with concrete, head shoe assembly 50 is lowered onto mold cavity 42. At 212, the concrete block machine begins vibrate the concrete and to compress the concrete with head shoe assembly 50. Concurrently, controller 104 begins to move moveable liner plate 40*a* toward the desired extended position from the starting position (e.g. retracted position, partially extended position). When magnetic sensor assembly 120 indicates via position signal 122 that moveable liner plate 40*a* has reached the desired extended position, such as desired extended position 132, controller 104 stops moving moveable liner plate 40*a* and maintains it at the desired extended position. In one embodiment, after reaching the desired extended position, the concrete block continues to vibrate and compress the concrete fill within mold cavity 42 to achieve a desired psi rating.

At 214, after the concrete has been compressed and vibrated, the one or more moveable liner plates are moved to a retracted position. At 216, after the one or more liner plates have been moved to a corresponding retracted position, the concrete block machines removes the formed masonry block from mold cavity 42 by moving head shoe assembly 50 and pallet 52 downward while mold assembly 30 remains stationary. At 218, head shoe assembly 50 is raised to an original starting position, and the above described process is repeated for the formation of each subsequent block.

As described above and by previously incorporated U.S. patent application Ser. No. 10/629,460, drive assembly 46 employing first and second gear elements 84 and 110 provides a robust drive assembly that enables moveable liner plate 40a to be moved to a desired extended position while the concrete fill within mold cavity 42 is being compacted by head shoe assembly 50 and vibrated by the concrete block machine. Additionally, magnetic sensor assembly 120 provides accurate indication of the position of moveable liner plate 40*a* and is not as susceptible to vibration and other adverse conditions (e.g. dirt, debris) as other types of sensors (e.g. position switches, optical sensors). Other types of drive assemblies, however, may be employed, such as those drive assemblies described by U.S. patent application Ser. No. 11/351,770 assigned to the same assignee as the present invention (now issued as U.S. Pat. No. 7,470,121), and which is incorporated herein by reference.

Additionally, although described herein primarily with respect to movement of a single liner plate and with respect to formation of a masonry retaining wall block, the teachings of the present invention apply to a mold assembly having multiple moveable liner plates and to the formation of other types of masonry blocks, such as architectural units, pavers, and cinder blocks, for example.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A method of making a masonry block employing a mold assembly having a plurality liner plates each having a major surface that together form a mold cavity having an open top and an open bottom, wherein at least one liner plate is moveable between a retracted position and a desired extended position within the mold cavity, the method comprising:

providing a negative of a desired texture on the major surface of the moveable liner plate;

moving the moveable liner plate to a retracted position;

closing the bottom of the mold cavity by positioning a pallet below the mold assembly;

filling the mold cavity with dry cast concrete via the open top;

vibrating the mold assembly and dry cast concrete therein;

moving the moveable liner plate toward a desired extended position after the mold cavity has been filled with dry cast concrete, before the open top of the mold cavity is closed, and while the mold cavity is vibrated;

closing the open top of the mold cavity with a head shoe assembly subsequent to commencement of the vibrating and the moving of the moveable liner plate toward the desired extended position; and completing compaction of the dry cast concrete after the open top is closed via the vibrating and movement of the head shoe assembly and completion of movement of the moveable liner plate to the desired extended position to form a pre-cured masonry block having a surface with the desired texture imparted therto.

2. The method of claim 1, wherein moving the moveable liner plate includes moving the moveable liner plate to the desired extended position based on a position signal from a magnetic position sensor that is indicative of a position of the moveable liner plate relative to an interior of the mold cavity.

3. The method of claim 1, wherein moving the moveable liner plate to a retracted position;

expelling the pre-cured masonry block from the mold cavity; and curing the pre-cured masonry block.

4. The method of claim 1, wherein the moveable liner plate is coupled via at least one guide post to a master bar which is configured to ride along a stationary support shaft, and wherein moving the moveable liner plate between the refracted position and the extended position includes moving the master bar toward and away from an interior of the mold cavity with a drive assembly which is operatively coupled to the master bar.

5. The method of claim 4, wherein the drive assembly comprises a gear drive assembly including:

a first gear element having a plurality of substantially parallel angled channels and selectively coupled between the master bar and the at least one movable liner plate;

a second gear element having a plurality of substantially parallel angled channels configured to slidably interlock with the angled channels of the first gear element; and an actuator selectively coupled to the second gear element and configured to move the master bar along the stationary support shaft and the moveable liner plate in a first direction toward an interior of the mold cavity by applying to the second gear element a force in a second direction, which is different from the first direction, causing the second gear element to move in the second direction and the first gear element, the master bar, and the moveable liner plate to move in the first direction toward the interior of the mold cavity, and to move the first gear element, the master bar, and the moveable liner plate opposite the first direction away from the interior of the mold cavity by applying to the second gear element a force in a direction opposite the second direction.

6. The method of claim 5, wherein the drive assembly moves the moveable liner plate between the extended and retracted position based on a position signal provided by a magnetic position sensor including a permanent magnet positioned on the master bar and a sensor probe positioned within a shaft internal to stationary support shaft, wherein the position signal indicative of the position of the permanent magnet relative to the sensor probe.

7. The method of claim 5, wherein the second direction is substantially perpendicular to the first direction.

8. A method of making a masonry block employing a mold assembly having a plurality liner plates each having a major surface that together form a mold cavity having an open top and an open bottom, wherein at least one liner plate is moveable between a retracted position and a desired extended position within the mold cavity, wherein the major surface of the moveable liner plate includes a negative of a desired texture, the method comprising:

moving the moveable liner plate to a retracted position;

closing the bottom of the mold cavity by positioning a pallet below the mold assembly;

filling the mold cavity with dry cast concrete via the open top;

vibrating the mold assembly and dry cast concrete therein;

moving the moveable liner plate toward a desired extended position after the mold cavity has been filled with dry cast concrete, before the open top of the mold is closed, and while the mold cavity is vibrated;

closing the open top of the mold cavity with a head shoe assembly after commencement of the vibrating and movement of the moveable liner plate toward the extended position; and completing movement of the moveable liner plate to the desired extended position and vibration of the dry cast concrete after the open top is closed with the head shoe assembly to form a pre-cured masonry block having a surface with the desired texture impressed thereon.

* * * * *